US010822740B2

(12) United States Patent
Li

(10) Patent No.: US 10,822,740 B2
(45) Date of Patent: Nov. 3, 2020

(54) PORTABLE CURTAIN CUTTER ASSEMBLY AND METHOD FOR USING THEREOF

(71) Applicant: Song Li, Arcadia, CA (US)

(72) Inventor: Song Li, Arcadia, CA (US)

( * ) Notice: Subject to any disclaimer, the term of this patent is extended or adjusted under 35 U.S.C. 154(b) by 50 days.

(21) Appl. No.: 16/024,615

(22) Filed: Jun. 29, 2018

(65) Prior Publication Data

US 2019/0330793 A1 Oct. 31, 2019

(30) Foreign Application Priority Data

Apr. 25, 2018 (CN) ..... 2018 1 0378015

(51) Int. Cl.

| | |
|---|---|
| ***D06H 7/02*** | (2006.01) |
| ***B26B 25/00*** | (2006.01) |
| ***B26B 29/02*** | (2006.01) |

(52) U.S. Cl.

CPC ..... *D06H 7/02* (2013.01); *B26B 25/007* (2013.01); *B26B 29/02* (2013.01); *Y10T 83/8763* (2015.04); *Y10T 83/8794* (2015.04)

(58) Field of Classification Search

CPC ..... D06H 7/02; B26B 29/02; B26B 25/007; Y10T 83/8794; Y10T 83/8763

USPC ..... 30/1, 2, 173, 194, 196, 283–284, 30/289–294, 280, 278, 246, 263

See application file for complete search history.

(56) References Cited

U.S. PATENT DOCUMENTS 1,876,075 A * 9/1932 Reichert, Jr. ..... B26D 1/0006 30/240
2,601,183 A * 6/1952 Unsinger ..... B27G 17/025 30/293
2,701,911 A * 2/1955 Maescher ..... B26F 1/3826 30/240
3,043,351 A * 7/1962 Davis ..... B23Q 9/0028 30/373
3,057,058 A * 10/1962 Sidney ..... B26B 27/005 30/2
3,174,225 A * 3/1965 Abraham ..... B28D 1/226 30/292
3,616,488 A * 11/1971 Barefield ..... A22C 21/063 452/106
3,639,983 A * 2/1972 Knipfing ..... B43M 7/00 30/294
3,641,854 A * 2/1972 Keesling ..... D06H 7/02 83/18
3,724,071 A * 4/1973 Hurtubise ..... B26B 5/008 30/287
3,893,238 A * 7/1975 Scholl ..... A47G 27/0487 30/294
4,001,936 A * 1/1977 Matsushita ..... B26B 5/005 30/287

(Continued)

*Primary Examiner* — Sean M Michalski
(74) *Attorney, Agent, or Firm* — Tommy SF Wang; Wang IP Law Group, P.C.

(57) ABSTRACT

The present application discloses a portable curtain cutter assembly comprising a base and a portable cutter. The base comprises a supporting plate; a side wall; and a slider. The side all is coupled to the supporting plate and comprises a first groove. The slider is slidably coupled to the side wall through the first groove, wherein the slider comprises a slot. The portable cutter comprises a blade, wherein the blade is capable of being inserted partially into the slot. A method or using the aforementioned portable curtain cutter assembly is also disclosed.

15 Claims, 6 Drawing Sheets

(56) References Cited

U.S. PATENT DOCUMENTS 4,062,116 A * 12/1977 Arnott ..... B26D 3/10 30/292
4,088,049 A * 5/1978 Benedict ..... B26D 1/18 83/240
4,385,440 A * 5/1983 Webb ..... B26B 27/00 30/294
4,553,328 A * 11/1985 Buscher ..... D06H 7/02 269/224
4,606,124 A * 8/1986 Figueroa ..... B26B 5/005 30/292
4,987,682 A * 1/1991 Minnick ..... B26B 29/02 30/289
5,103,566 A * 4/1992 Stebe ..... B23Q 1/4804 30/376
5,197,195 A * 3/1993 Aikens ..... B25H 7/04 30/293
5,299,515 A * 4/1994 Baba ..... D06H 7/02 112/130
5,600,892 A * 2/1997 Peugh ..... B26B 29/06 30/292
5,732,472 A * 3/1998 Praye ..... B25H 7/02 30/293
5,881,463 A * 3/1999 Casteel ..... B26B 29/00 30/280
5,966,820 A * 10/1999 Cornacchio ..... B26B 29/06 30/286
5,979,063 A * 11/1999 Pritz ..... B26B 29/06 30/293
5,996,237 A * 12/1999 Sanders ..... B26B 29/06 30/293
6,195,896 B1 * 3/2001 Ireland ..... B26B 5/005 30/2
6,216,355 B1 * 4/2001 Darnell ..... B23Q 9/0028 33/42
6,240,645 B1 * 6/2001 Ozeki ..... A41H 31/005 30/240
6,421,923 B1 * 7/2002 Nguyen ..... B26B 5/005 30/287
6,467,174 B1 * 10/2002 Kotori ..... B26B 29/06 30/293
6,484,405 B1 * 11/2002 Martelli ..... B26B 25/005 30/292
6,591,509 B2 * 7/2003 LeBlanc ..... B23Q 9/0078 30/374
6,604,296 B2 * 8/2003 Mastrobattista ..... B23Q 9/0042 30/293
6,625,889 B2 * 9/2003 Belsaas ..... B23D 79/08 30/125
6,757,981 B2 * 7/2004 Hampton ..... B27B 9/04 30/372
6,941,664 B1 * 9/2005 Engle ..... E04D 15/02 30/286
7,287,329 B2 * 10/2007 Cornacchio ..... B26B 29/06 30/282
7,370,426 B2 * 5/2008 Choi ..... B25H 7/00 30/293
7,610,839 B1 * 11/2009 Bessette ..... B23Q 9/0014 30/373
7,690,120 B2 * 4/2010 Sieke ..... B26D 3/28 30/280
7,752,758 B2 * 7/2010 Gelardi ..... B65D 83/0463 206/528
7,845,083 B1 * 12/2010 Cora Rosa ..... B43L 7/02 30/293
8,020,312 B1 * 9/2011 McGahan ..... B26B 29/06 33/770
8,042,439 B2 * 10/2011 Nayak ..... B23D 51/025 30/290
8,171,647 B2 * 5/2012 Gullicks ..... B26B 3/00 30/2
8,430,880 B2 * 4/2013 Gil ..... A61B 17/1635 30/282
8,438,740 B2 * 5/2013 Fischer ..... B27B 9/02 30/293
8,650,761 B2 * 2/2014 Haas ..... B25H 1/0078 30/293
2001/0029673 A1 * 10/2001 Brown ..... B26B 29/06 30/293
2002/0069803 A1 * 6/2002 Resta ..... D05B 33/00 112/470.12
2003/0037446 A1 * 2/2003 Saunders ..... B23Q 9/0028 30/481
2003/0154835 A1 * 8/2003 Nunez ..... B26D 1/0006 83/614
2004/0103540 A1 * 6/2004 Tilley ..... B23D 45/003 30/123.3
2006/0278053 A1 * 12/2006 Lampe ..... D06H 7/02 83/78
2007/0186745 A1 * 8/2007 Loibl ..... B26B 25/007 83/565
2008/0250654 A1 * 10/2008 Chang ..... B26B 29/02 30/292
2009/0205211 A1 * 8/2009 Nickels, Jr. ..... B27B 9/02 30/516
2009/0223067 A1 * 9/2009 Zhang ..... B23D 17/08 30/294
2010/0242290 A1 * 9/2010 Pugh ..... B28D 1/226 30/277.4
2011/0283546 A1 * 11/2011 Abreu ..... B26B 29/00 30/278
2012/0096720 A1 * 4/2012 Neubauer ..... A63C 7/04 30/289
2013/0014394 A1 * 1/2013 Yu Chen ..... B26B 25/005 30/276
2013/0061475 A1 * 3/2013 Lutgen ..... B25G 1/102 30/151
2014/0138038 A1 * 5/2014 Lasry ..... A47H 1/18 160/330
2015/0068045 A1 * 3/2015 Allen ..... B26B 29/06 30/293
2015/0107119 A1 * 4/2015 Yu Chen ..... B26B 27/005 30/283
2015/0202784 A1 * 7/2015 Ranfelt ..... B26B 29/00 30/287
2015/0321363 A1 * 11/2015 Peppett ..... B26B 5/005 30/290
2016/0121508 A1 * 5/2016 Levitin ..... B26D 1/285 83/18
2020/0108517 A1 * 4/2020 Kiley ..... B26B 29/00

* cited by examiner

PORTABLE CURTAIN CUTTER ASSEMBLY AND METHOD FOR USING THEREOF

CROSS-REFERENCE TO RELATED APPLICATION

This application claims priority benefit from China Patent Application No. 201810378015.X, filed on Apr. 25, 2018 in the State Intellectual Property Office of the P.R.C, the disclosure of which is incorporated herein by reference in its entirety.

TECHNICAL FIELD OF THE INVENTION

The present application generally relates to a cutter, and more particularly, to a portable curtain cutter assembly and a method for using thereof.

BACKGROUND OF THE INVENTION

Since each house has different curtain size and length, it is hard to mass manufacture certain scale of curtains for every family. Therefore, people generally hand cut the curtain for adjustment to a desired size.

However, the bottom edge of the curtain will be curved since the upper portion is draped when hanging up. For this reason, it is common for consumers to order customized curtains. But it not only increases the costs but creates even more problems if the customized curtain is incompatible with the house due to mismeasurement.

Therefore, a need remains for a portable curtain cutter assembly and a method for using thereof to provide an improved qualify of curtain to meet the demand of each different house.

SUMMARY OF THE INVENTION

The present application discloses a portable curtain cutter assembly and a method for using thereof to provide an improved qualify of curtain to meet the demand of each different house.

The portable curtain cutter assembly comprises a base and a portable cutter. The base comprises a supporting plate; a side wall; and a slider. The side wall is coupled to the supporting plate and comprises a first groove. The slider is slidably coupled to the side wall through the first groove, wherein the slider comprises a slot. The portable cutter comprises a blade, wherein the blade is capable of being inserted partially into the slot.

In various exemplary embodiments, the base further comprises a screw and a plurality of holes arranged in a column, the screw is capable of being inserted into the plurality of holes. The screw may be a wing screw.

In various exemplary, embodiments, the side wall comprises a second groove, one end of the slider is coupled to the first groove while another end of the slider is coupled to the second groove.

In various exemplary embodiments, wherein the portable cutter further comprises a case defining an accommodation space, the blade is disposed inside the accommodation space. The portable cutter further comprises a fastener coupled to the case. The fastener comprises a rod; a fixture; a roller; a spring and a connector. The rod is hollow and is coupled to the case. The fixture is coupled to the rod. The roller is coupled to the fixture. The spring partially disposed inside the rod. A diameter of the spring is 0.6 mm. A length of the spring is 30 mm. The connector is disposed inside the rod and coupled to the spring, wherein the rod and the case are coupled via the spring and the connector.

In various exemplary embodiments, wherein the portable cutter further comprises a case defining an accommodation space, the blade is disposed inside the accommodation space; and a handle coupled to the case and comprising stainless steel.

In various exemplary embodiments, the base further comprises a fixing bar, a first bar, a second bar, a positioning rod and a spring. The fixing bar is disposed on the supporting plate. The first bar is rotatably coupled to the fixing bar. The second bar is coupled to the first bar. The positioning rod is coupled to the fixing bar. The spring is coupled between the positioning rod and the first bar, wherein the first bar is rotated about the fixing bar via the spring and the positioning rod.

A method for using the aforementioned portable curtain cutter assembly is, also disclosed. The method for using the portable curtain cutter assembly comprises: installing the slider into the first groove of the base; inserting the blade partially into the slot of the slide; placing a curtain between the blade and the slider; and moving the curtain along the slot.

In various exemplary embodiments, the step of moving the curtain along the slot comprises moving the curtain horizontally.

In various exemplary embodiments, before placing the curtain between the blade and the slider, the method further comprises draping the curtain.

Based on the above, the present application allows consumers to have customized curtains simply via using the portable curtain cutter assembly at their houses, reducing the risk of having an incompatible-sized curtain due to mismeasurement. In addition, since the present application discloses a method for cutting a draped curtain, the problem of having a curved bottom edge of curtain can be reduced either.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
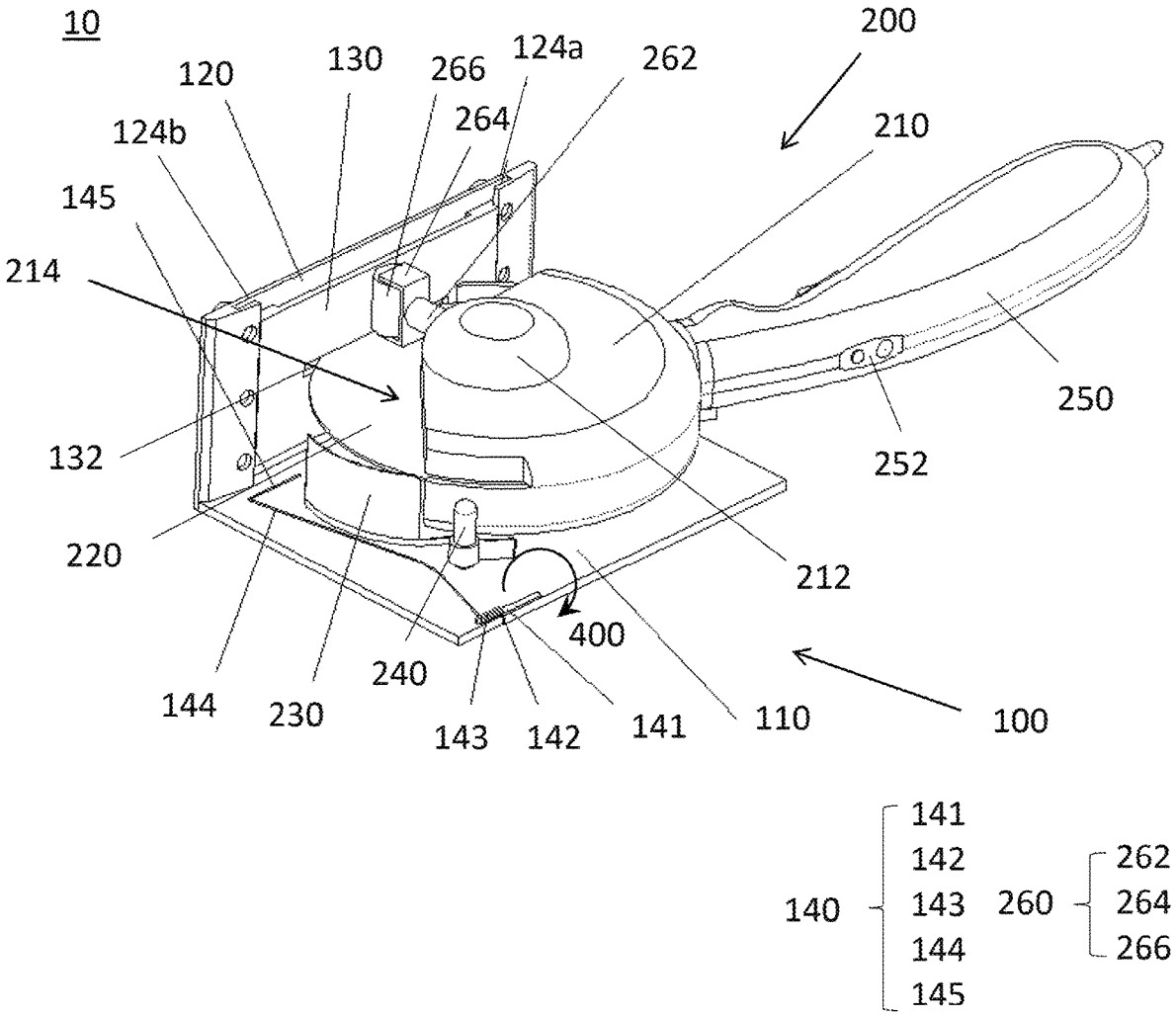
FIG. 1 is view showing a portable curtain cutter assembly.

Reference will now be made in detail to the present representative embodiments of the present application, examples of which are illustrated in the accompanying drawings. Wherever possible, the same reference numbers are used in the drawings and the description to refer to the same or like parts.

FIG. 1 is view showing a portable curtain cutter assembly 10.

Referring to FIG. 1, the portable curtain cutter assembly 10 comprises a base 100 and a portable curtain cutter 200. The base 100 comprises a supporting plate 110, a side wall 120, a slider 130 and a fixing assembly 140.

The supporting plate 110 is coupled to the side wall 120. Specifically, one edge of the supporting plate 110 is coupled to one end of the side wall 120, making the supporting plate 110 and the side wall 120 to be connected vertically. A top surface of the supporting plate 110 serves as an operating platform for cutting a curtain.

The side wall 120 comprises two grooves 124*a*/124*b*. Specifically, both a left side and a right side of the side wall 120 comprise an insert parts which include the grooves 124*a*/124*b*, defining an accommodation space for foe slider 130.

The slider 130 is slidably coupled to the side wall 120 through both of the grooves 124*a*/124*b*. Specifically, a left side and a right side of the slider 130 are capable of being inserted into the grooves 124*a*/124*b* respectively. The slider 130 comprises a slot 132.

Figure 2:
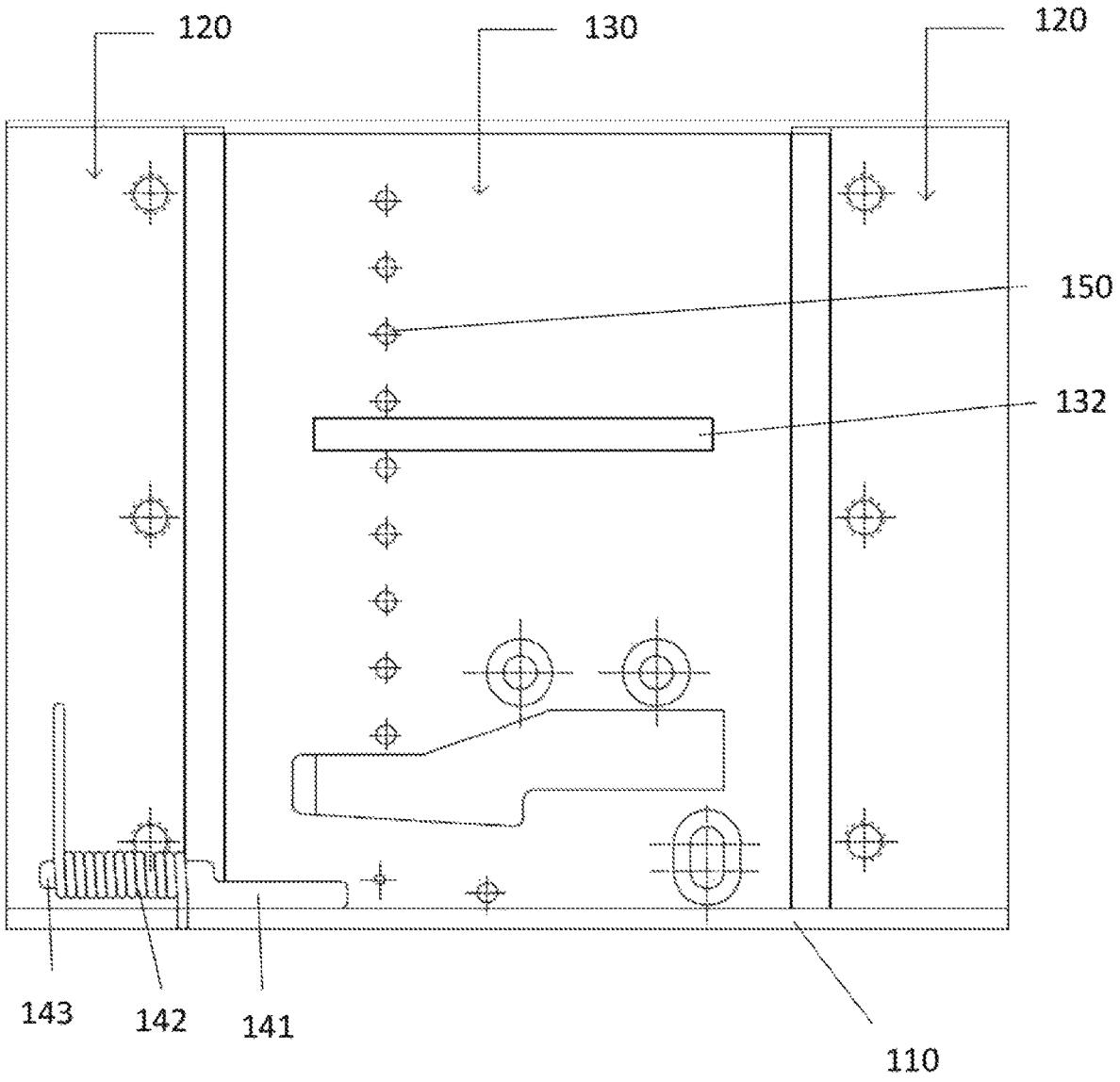
FIG. 2 is a front view a base of the portable curtain cutter assembly.
Figure 3:
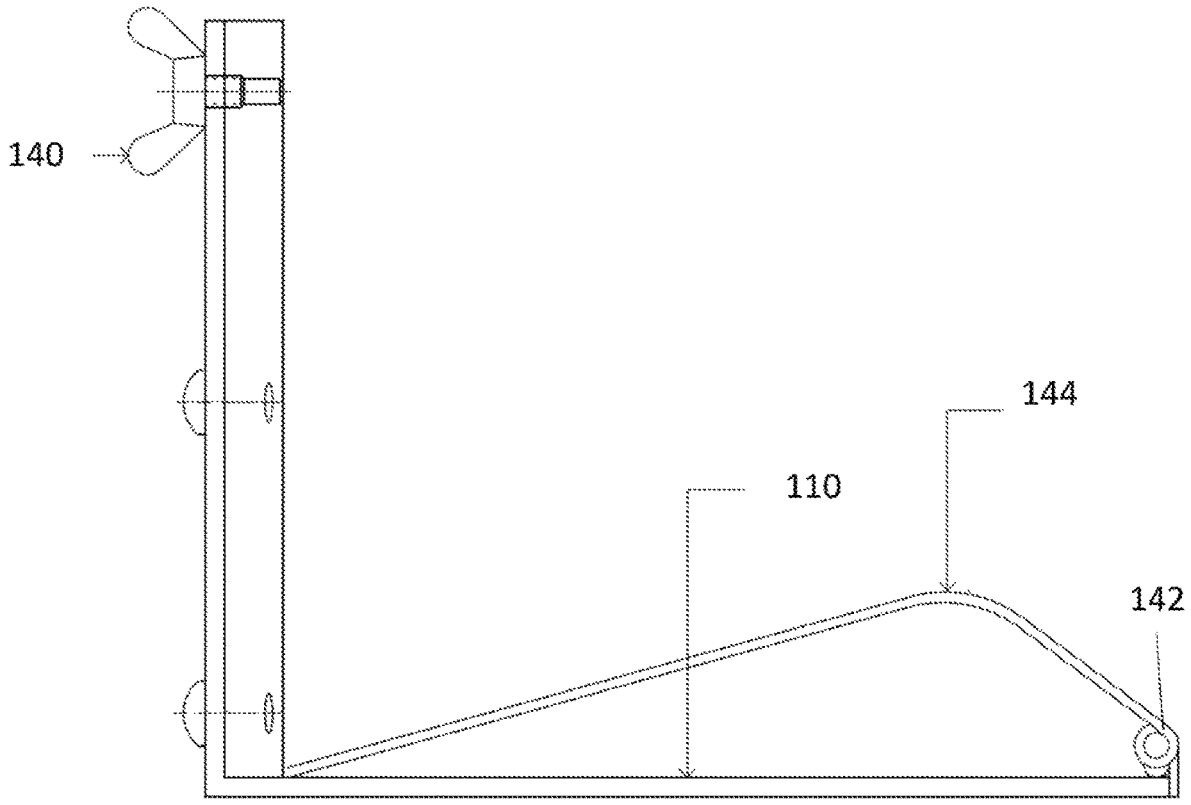
FIG. 3 is a side view of the base of the portable curtain cutter assembly.

FIG. 2 is a front view of a base 100 of the portable curtain cutter assembly 10. FIG. 3 is a side view of the base 100 of the portable curtain cutter assembly 10.

As shown in FIGS. 2-3, the base 100 further comprises a screw 140 and a plurality of holes 150 arranged in a column. The screw 140 is capable of being inserted into the holes 150. Specifically, the user can select a specific hole 150 for a desired height for positioning the slider 130. The screw in the present application is a wing screw as an example, but the present application is not limited thereto. In addition, it should be noted that the amount of the boles 150 is not limited either, the amount of holes 150 in FIG. only shows as an example.

Referring to FIGS. 1-3, the fixing assembly 140 comprises a fixing bar 141, a spring 142, a positioning rod 143, a bar 144 and a bar 145. The fixing bar 141 is disposed and fixed on the supporting plate 110. The positioning rod 143 is coupled to the fixing bar 141. The spring 142 is a torsion spring and is installed with the positioning rod 143.

The bar 144 is rotatably coupled to the fixing bar 141. Specifically, the bar 144 can be rotated about the fixing bar 141 via the spring 142 and the positioning rod 143. The spring 142 is capable of being deformed while the bar 144 is rotated along the arrow 400 because the poisoning rod 143 fixes one end of the spring 142 is a fixed position. The bar 145 is coupled to the bar 144 vertically.

Therefore, the user may put the curtain in a desired place after rotating the bar 144 and the bar 145 along the arrow 400. Then, rotating the bar 144 and the bar 145 back to the original places for fixing the curtain, allowing the curtain to be disposed in a desired place. The bar 144 in the present application is curved as an example. However, the present application is not limited thereto. In addition, the spring 142, the bar 144 and the bar 145 are molded integrally in the present application only as an example.

Figure 4:
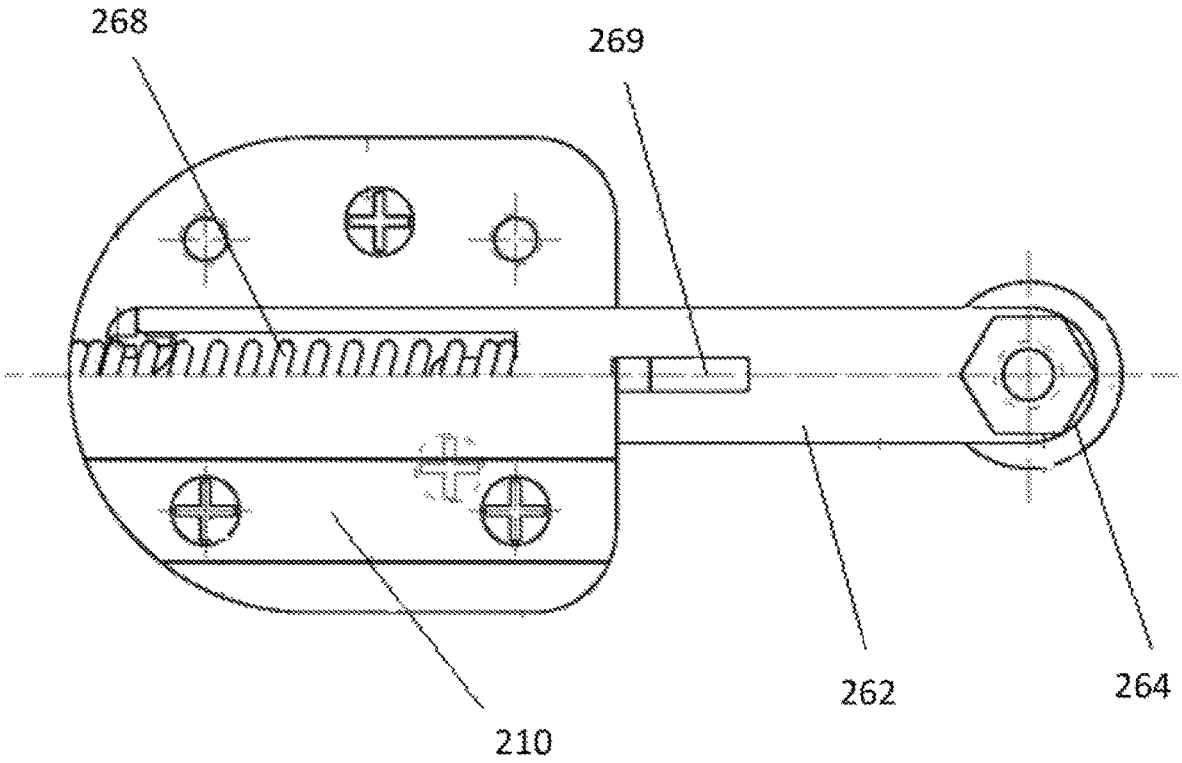
FIG. 4 is a bottom view of a fastener of the portable curtain cutter assembly.

FIG. 4 is a bottom view of a fastener 260 of the portable curtain cutter assembly 10.

Referring to FIG. 1 and FIG. 4, The portable curtain cutter 200 comprises a case 210, a blade 220, a cover 230, a pivot 240, a handle 250 and a fastener 260.

The case 210 comprises a mounting space 212 and defines an accommodation space 214. The case 210 in the present application is circular shape as an example, but the present application is not limited thereto.

The blade 220 is disposed inside the accommodation space 214. The cover 230 is pivotally coupled to the case 210 via the pivot 240, increasing the safety when the portable curtain cutter 200 is in use. It should be noted that the cover 230 also be coupled to the case 210 by other methods such as working as a lid or being coupled via screw, the present application is not limited thereto.

The handle 250 comprises a switch 252 for turning the portable curtain cutter 200 on or off.

The fastener 260 is disposed partially inside the mounting space 212 at a top surface of the case 210 for securing the curtain in a desired location. The fastener 260 comprises a rod 262, a fixture 264, a roller 266, a spring 268 and a connector 269.

FIG. 4 shows a view of a bottom surface of the rod 262 being partially removed for clear description of the structure of the fastener 260.

The roller 266 is coupled to the fixture 264. The fixture 264 is coupled to the rod 262. The rod 262 is coupled to the case 210 through the spring 268 and the connector 269. Specifically, the rod 262 is hollow and the spring 268 is partially disposed inside the rod 262 and the connector 269 is disposed inside the rod 262 and coupled to the spring 268. When pressing the roller 266 toward the case 210, the connector 269 may be pressed by the roller 264, making the spring 268 be compressed. The spring 268 is released after placing the curtain in the desired location, further securing the curtain in the fixed location.

A diameter of the spring 268 is 0.6 mm while a length of the spring 268 is 30 mm. However, the present application is not limited thereto, the diameter and the length of the spring 268 can be modified if needed.

By the above structure, the curtain may be secured in a desired location after measurement. In addition, the roller 266 may be rolled when moving the curtain, allowing the curtain be maintained in a same height level.

Figure 5:
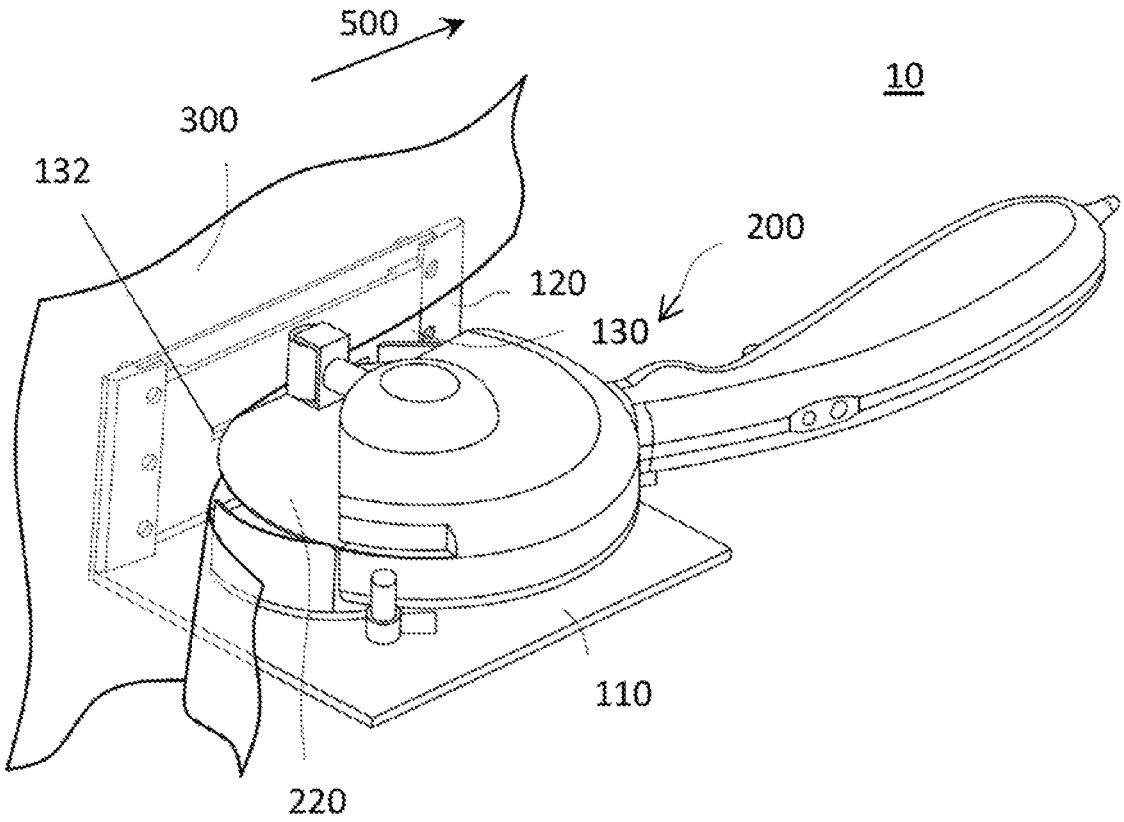
FIG. 5 is a view showing a fabric being cut by the portable curtain cutter assembly.

FIG. 5 is a view showing a fabric 300 being cut by the portable curtain cutter assembly 10.

Referring to FIG. 5, as an example, the fabric 300 is moved along the arrow 500 while the portable curtain cutter assembly 10 keeping in a same place. By moving the fabric 300, the fabric 300 is cut along the direction of the blade 220 and the slot 132.

Figure 6:
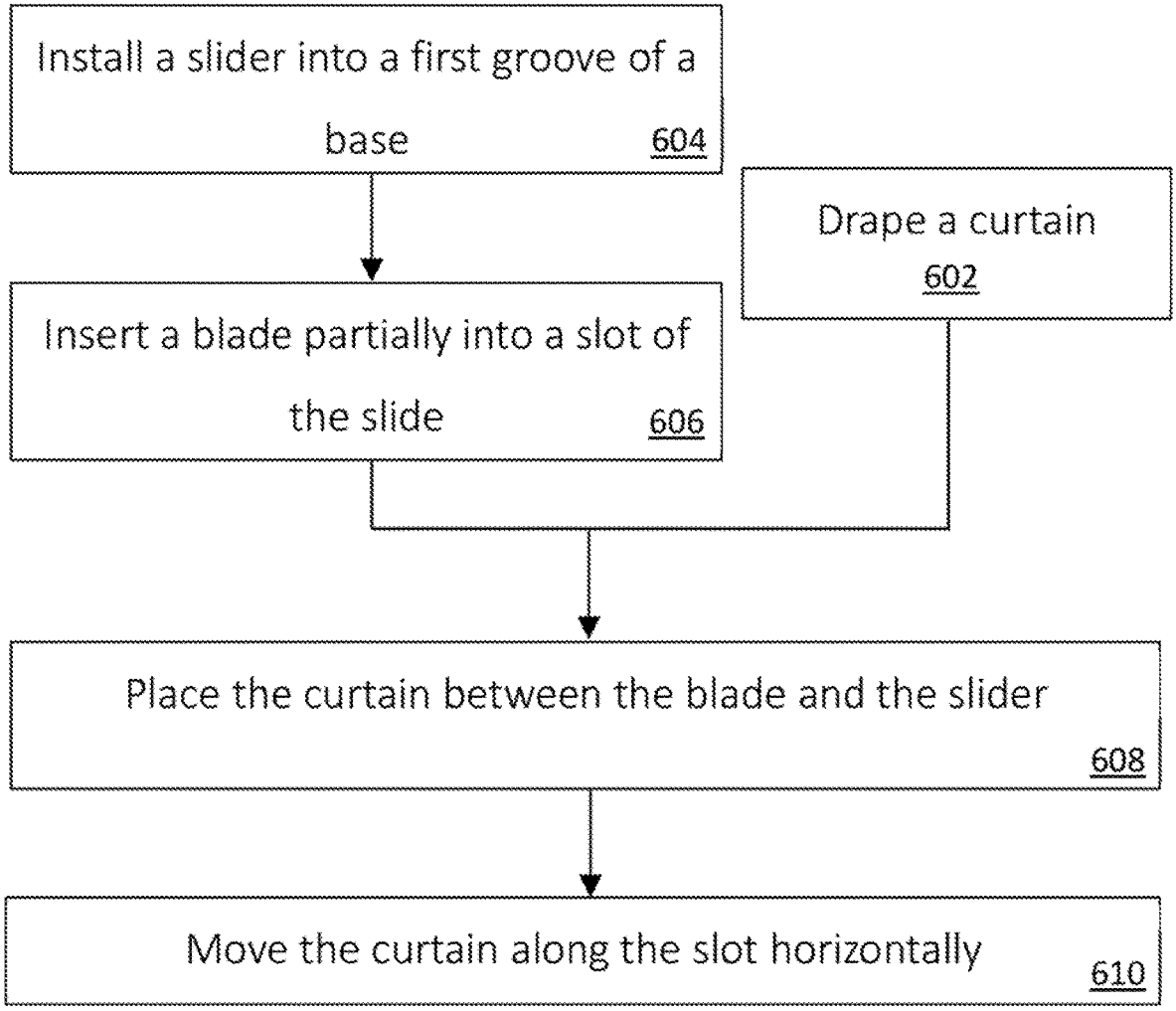
FIG. 6 is to flow chart of a method for using the portable curtain cutter assembly.

FIG. 6 is a flow chart of a method for using the portable curtain cutter assembly 10.

Referring to FIG. 1 and FIG. 6, as shown in a first initial step 602, draping the curtain before cutting the curtain by the portable curtain cutter assembly 10.

In addition, as shown n a second initial step 604, installing the slider 130 into the grooves 124*a*/124*b* of the base 100. After that, inserting the blade 210 partially into the slot 132 of the slide 130 as shown in step 606.

Referring to step 608, then placing the curtain between the blade 220 and the slider 130. Then moving the curtain along the slot 132 horizontally as shown in step 610.

Based on the above, the present application allows consumers to have customized curtains simply via using the portable curtain cutter assembly at their houses, reducing the risk of having an incompatible-sized curtain due to mismeasurement. In addition, since the present application discloses a method for cutting a draped curtain, the problem of having a curved bottom edge of curtain can be reduced.

Meanwhile, since the roller 266 can secure the curtain in the desired location, the curtain can be placed more stable while cutting, further reducing the deviation. Furthermore, the cover may work as a protector to avoid unnecessary harm while using the portable curtain cutter assembly.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A method for using a portable curtain cutter assembly, wherein the portable curtain cutter assembly comprises:

a base comprising:

a supporting plate;

a side wall coupled to the supporting plate and comprising a first groove; and a slider slidably coupled to the side wall through the first groove, wherein the slider comprises a slot; and a portable cutter comprising a blade, wherein the blade is capable of being inserted partially into the slot, wherein the method for using the portable curtain cutter assembly comprises:

installing the slider into the first groove of the base;

inserting the blade partially into the slot of the slide;

placing a curtain between the blade and the slider; and moving the curtain along the slot.

2. The method for using the portable curtain cutter assembly as claimed in claim 1, wherein the step of moving the curtain along the slot comprises moving the curtain horizontally.

3. The method for using the portable curtain cutter assembly of claim 1, wherein before placing the curtain between the blade and the slider, the method further comprises draping the curtain.

4. The method for using the portable curtain cutter assembly as claimed in claim 1, wherein the base further comprises a screw and a plurality of holes arranged in a column, the screw is capable of being inserted into the plurality of holes.

5. The method for using the portable curtain cutter assembly as claimed in claim 4, wherein the screw is a wing screw.

6. The method for using the portable curtain cutter assembly as claimed in claim 1, wherein the side wall comprises a second groove, one end of the slider is coupled to the first groove while another end of the slider is coupled to the second groove.

7. The method for using the portable curtain cutter assembly as claimed in claim 1, wherein the portable cutter further comprises a case defining an accommodation space, the blade is partially located inside the accommodation space.

8. The method for using the portable curtain cutter assembly as claimed in claim 7, wherein the portable cutter further comprises a fastener coupled to the case.

9. The method for using the portable curtain cutter assembly as claimed in claim 7, wherein the fastener comprises:

a rod coupled to the case;

a fixture coupled to the rod; and a roller coupled to the fixture.

10. The method for using the portable curtain cutter assembly as claimed in claim 9, wherein the rod is hollow and the fastener further comprises:

a spring partially disposed inside the rod; and a connector disposed inside the rod and coupled to the spring, wherein the rod and the case are coupled via the spring and the connector.

11. The method for using the portable curtain cutter assembly as claimed in claim 10, wherein a diameter of the spring is 0.6 mm.

12. The method for using the portable curtain cutter assembly as claimed in claim 10, wherein a length of the spring is 30 mm.

13. The method for using the portable curtain cutter assembly as claimed in claim 7, wherein the portable cutter further comprises a cover pivotally coupled to the case.

14. The method for using the portable curtain cutter assembly as claimed in claim 7, wherein the portable cutter further comprises a handle coupled to the case.

15. The method for using the portable curtain cutter assembly as claimed in claim 14, wherein the handle comprises stainless steel.

* * * * *